US005812358A

United States Patent [19]

Kawai et al.

[11] Patent Number: 5,812,358

[45] Date of Patent: Sep. 22, 1998

[54] SHEATHED STEEL PIPE WITH CONDUCTIVE PLASTIC RESIN

[75] Inventors: Hisaji Kawai; Shuji Yoshino, both of Shizuoka, Japan

[73] Assignee: Yazaki Industrial Chemical Co. Ltd., Shizuoka, Japan

[21] Appl. No.: 632,015

[22] Filed: Apr. 10, 1996

Related U.S. Application Data

[63] Continuation-in-part of Ser. No. 208,282, Mar. 10, 1994, abandoned.

[51] Int. Cl.[6] ..... H05F 3/02

[52] U.S. Cl. ..... 361/215; 361/212; 361/220

[58] Field of Search ..... 361/212, 215, 361/220

[56] References Cited

U.S. PATENT DOCUMENTS

| | | | |
|---|---|---|---|
| 2,215,283 | 9/1940 | Adler | 361/215 |
| 2,316,824 | 4/1943 | Tobias et al. | 361/212 |
| 3,070,132 | 12/1962 | Sheridan | 361/215 |
| 3,555,170 | 1/1971 | Petzetakis | 361/215 |
| 3,580,983 | 5/1971 | Jackson | 361/215 |
| 3,907,955 | 9/1975 | Viennot | 361/215 |
| 3,914,002 | 10/1975 | Berliner et al. | 361/215 |

OTHER PUBLICATIONS

GPI Web Client abstract with image of 04–4384, Koda et al., Jan. 1992, Japan F16L 9/12.

*Primary Examiner*—Fritz Fleming
*Attorney, Agent, or Firm*—Eric P. Schellin

[57] ABSTRACT

A pipe body sheathed with a film of plastic resin. A strip of conductive plastic resin is along the entire length of the pipe body and made integral with the resin film by extrusion. The conductive strip readily discharges static electricity that may develop in a structure made of said pipes. They are connected to have their conductive strips end-to-end, thereby grounding the so built structure.

2 Claims, 5 Drawing Sheets

SHEATHED STEEL PIPE WITH CONDUCTIVE PLASTIC RESIN

BACKGROUND OF THE INVENTION

This is a continuation-in-part of U.S. application Ser. No. 08/208,282, filed Mar. 10, 1994, now abandoned.

1) Field of the Invention

This invention relates in general to a sheathed steel pipe as the building block to make structures, and particularly to such a pipe composed of a tubular body, a film of plastic resin there about and a strip of conductive plastic resin.

2) Description of the Prior Art

Structures, such as gravity-feed chute rack storage units and roller conveyors are made of steel pipes having with a small wall thickness and a diameter of 28–32 millimeters, sheathed overall with an approximately 1 millimeter-thick film of plastic resin mixed with carbon black as the conductive additive to release electrostatic charge that may occur in the structure from operation. In typical applications, these conventional pipes may be made of carbon steel with a wall thickness of 0.7 millimeter.

However, the prior-art sheathed steel pipes with conductive plastic resin have been found to pose problems. For one, carbon black normally used as the conductive material for the film layer is expensive and its black color generates limitations when designers try to give a pipe structure decorative appearance. In addition, the film layer of carbon black does not resist impact well and easily fall from the sheathed surface.

To illustrate, if the width of carbon black forming is less than 5 millimeters, the pipe fails to show sufficient conductivity to prevent electrification. Above 15 millimeters, the pipe costs too expensive and gives poor appearance due to its black tone.

It was these drawbacks of the conventional sheathed steel pipes with conductive plastic resin that gave rise to the present invention.

SUMMARY OF THE INVENTION

It is a primary object of the present invention to provide a sheathed steel pipe with conductive plastic resin which is not expensive and can also give colorful appearance. The sheathed steel pipe is sheathed overall with a film of a plastic resin that is tinted in green or ivory. A narrow strip of a electrical conductive resin mixed with carbon black as the conductive additive is longitudinally formed along the length of the sheathed steel pipe, over the film forming, to make the sheathed steel pipe conductive to prevent electrification.

BRIEF EXPLANATION OF THE ACCOMPANYING DRAWINGS

DETAILED DESCRIPTION OF THE INVENTION

Preferred embodiments of this invention will be described in full detail in conjunction with the accompanying drawings.

Figure 1:
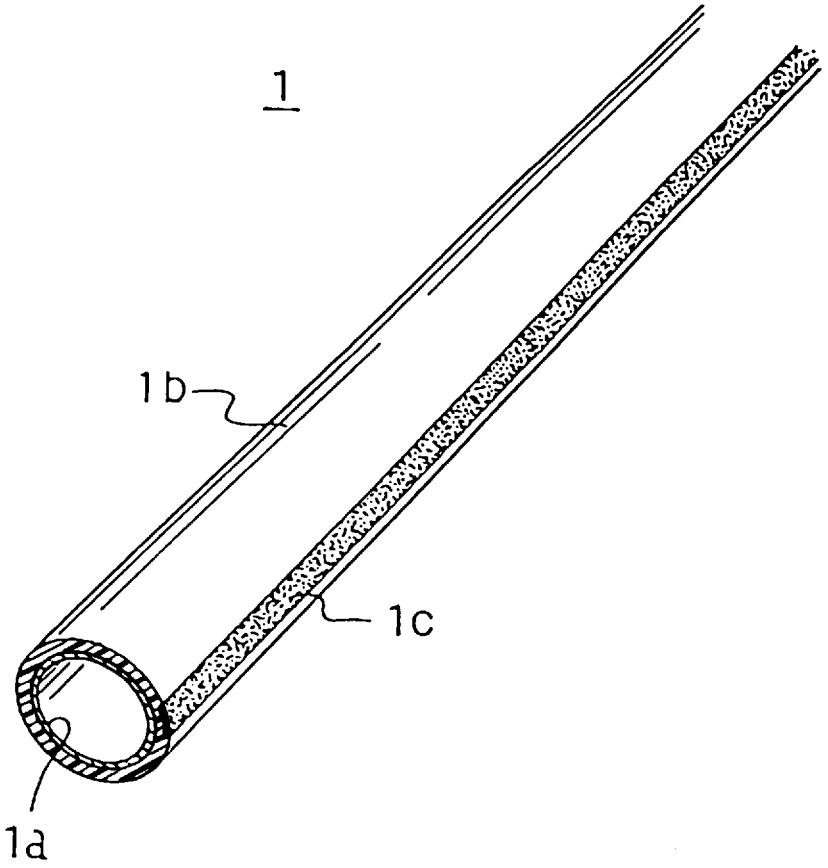
FIG. 1 is a perspective view of a sheathed steel pipe with conductive plastic resin designed in accordance with a first preferred embodiment of the present invention.

In FIG. 1, a sheathed steel pipe 1 with conductive plastic resin manufactured according a first preferred embodiment of the present invention is shown.

The tubular body 1*a* being formed of a steel pipe is coated externally with an approximately 1-millimeter film 1*b* of a plastic resin such as Acrylate Styrene Acrylonitrile copolymer (ASA). In addition, the film of plastic resin 1*b* has a strip of conductive resin 1*c* formed over the longitudinal length of the film of plastic resin 1*b* along the entire length of the tubular body 1*a*.

After sheathing of the film of plastic resin 1*b*, the sheathed steel pipe 1 ranges in diameter between 28 millimeters and 32 millimeters.

The film of plastic resin 1*b* may preferably be tinted in green or ivory to give decorative appearance.

The strip of conductive resin 1*c* may preferably comprise a conductive plastic resin, such as Acrylonitrile Butadien Styrene copolymer (ABS) mixed with carbon black as the conductive additive, and measure 15 millimeters in width and 0.5 millimeter in thickness. The strip of conductive resin 1*c* and the film of plastic resin 1*b* may preferably be formed integrally by press extruding.

The aim of the strip of conductive resin 1*c* is to release the electrostatic charge that may occur in the sheathed steel pipes 1, grounding the pipe structure in which the sheathed steel pipes 1 are connected with their strip of conductive resin 1*c* aligned end-to-end.

Figure 2:
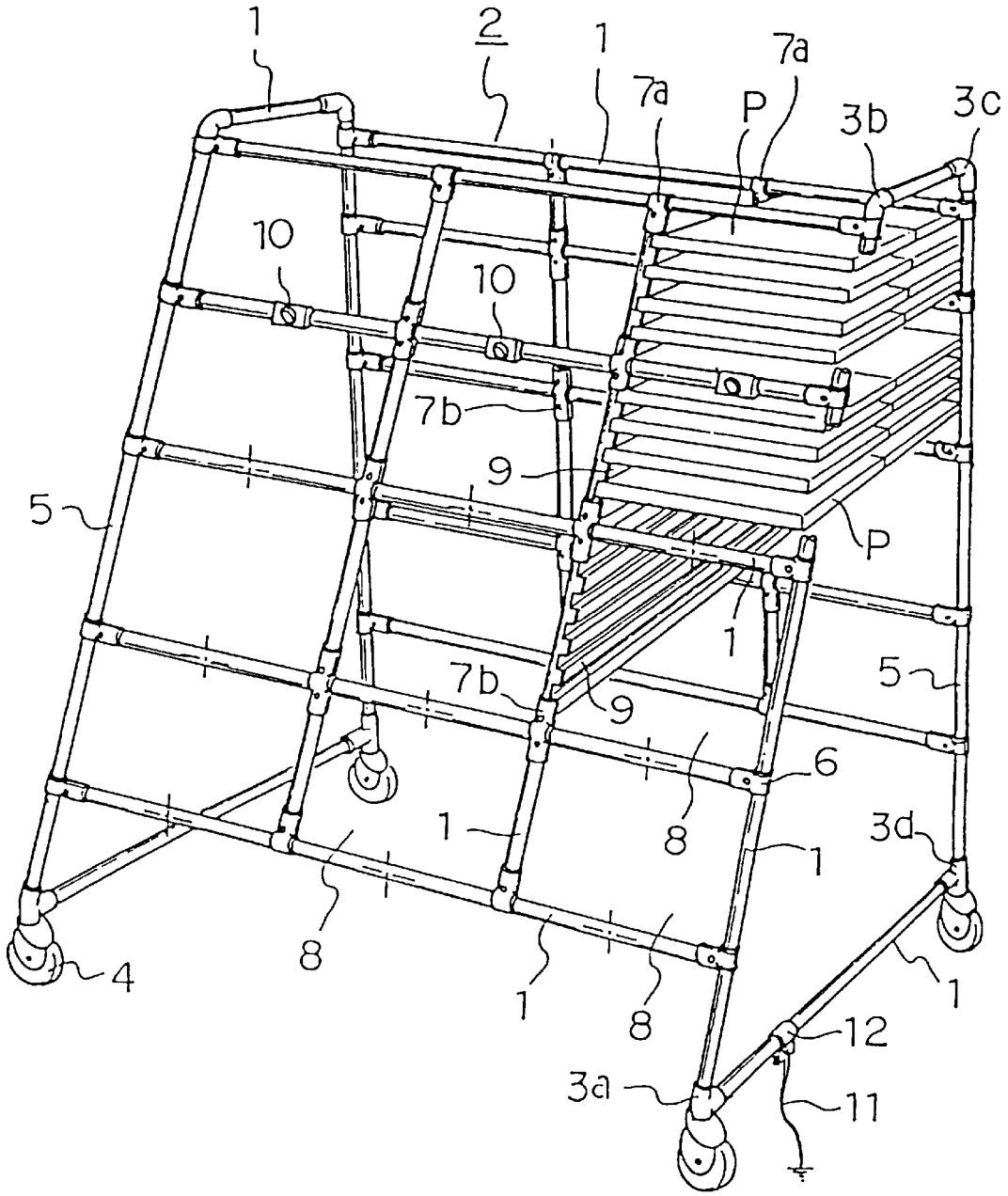
FIG. 2 is a perspective view of a gravity-feed chute-rack storage unit constructed into a structure of sheathed steel pipes of FIG. 1, designed to shelve printed-circuit boards.

A plurality of vertical and horizontal sheathed steel pipes 1 may be connected and assembled into a gravity-feed flow-rack storage unit to shelve printed-circuit boards, as shown in FIG. 2.

The storage unit comprises a rack framework 2 including a pair of upright sides, each build with a number of sheathed steel pipes 1 jointed end-to-end through largely L-shaped corner joints 3*a*, 3*b*, 3*c* and 3*d* which should be made of conductive metal or conductive plastic resin material, into a trapezoid.

The framework 2 may be supported on casters 4 to make the storage unit easy to move.

A plurality of T-joints 6, which are also made of conductive metal or conductive plastic resin material, couple the paired sides 5 to form the upright front and rear sides of the storage unit in which the steel pipes 1 are connected end-to-end with a plurality of T-joints 7*a* and cross joints 7*b* that are made of conductive metal or conductive plastic resin material.

With this arrangement, the front side of the storage unit, as shown in FIG. 2, has a plurality of substantially rectangular frames composed of horizontal and vertical sheathed steel pipes 1 and joints 7*a*, 7*b* between the trapezoidal sides 5.

The rectangular frames form ports 8 through which printed-circuit boards are loaded or unloaded out of the chute storage unit.

Each loading/unloading port 8 has therein a layer of leveled pairs of chute rails 9 that extend between the front and rear sides of the storage unit and tilted downward toward the front side to keep printed-circuit boards P in the manner of gravity-feed storage. In the drawing, the guide rails 9 are shown on the one side of the pairs alone for brevity's sake. With this arrangement, separate loading/unloading ports 8 in a chute storage unit may be labeled to hold different kinds of electronic boards P.

In addition, each loading/unloading port 8 is provided with a detection lamp 10 that may preferably be mounted at a mid-point in the top pipe of the port, which is lit up to help storehouse workers located particular ports 8.

Preferably, a pair of a photoelectric scanner and a mirror, both not shown, are installed at aligned locations across the loading/unloading port for each pair of chute rails 9.

The associated scanner-and-mirror combination detects the loading or unloading of a printed-circuit board P as the board blocks the beam from the scanner to the mirror when a warehouse worker is attending at a particular port 8. The scanners and the detection lamps 10 are connected through cables, not shown, to a central computer program, not shown, which keeps track of loadings or unloadings for a chute storage unit, and energizes a buzzer, not shown, to warn if an attempt is made to access the wrong port 8.

Moreover, in the bottom horizontal pipe section 1 of one of the side trapezoids 5 is provided with a largely inverted U-shaped grounding terminal 12 with a lead 11 to discharge static electricity that may develop from friction by sliding printed-circuit boards P against their respective chute rails 9 when they are loaded or unloaded. In the structure of the illustrated chute storage unit, the electrostatic charge that may occur in the steel pipes 1 will be let to discharge through the grounding terminal 12 and lead 11 via the conductive joints 3*a*, 3*b*, 3*c*, 3*d*, 6, 7*a*, 7*b*.

It must be noted that, in this particular embodiment, printed-circuit boards P are stored horizontally between chute rails 9 that are mounted in the vertical pipes of the loading/unloading ports 8.

However, this is a matter of choice, and in a modified form of gravity-feed storage unit, the boards P may be stored in vertical position, between the top and bottom sheathed steel pipes 1 of the ports 8.

In addition, in an alternative modification, the grounding terminal 12 and lead 11 may be replaced by casters 4 that are made of an electrically conductive plastic resin material to ground the chute storage unit.

This design would help avoid inconvenience on a scattered storage floor where the trailing lead 11 can be caught by obstructs when the storage unit has to be wheeled around.

Figure 3:
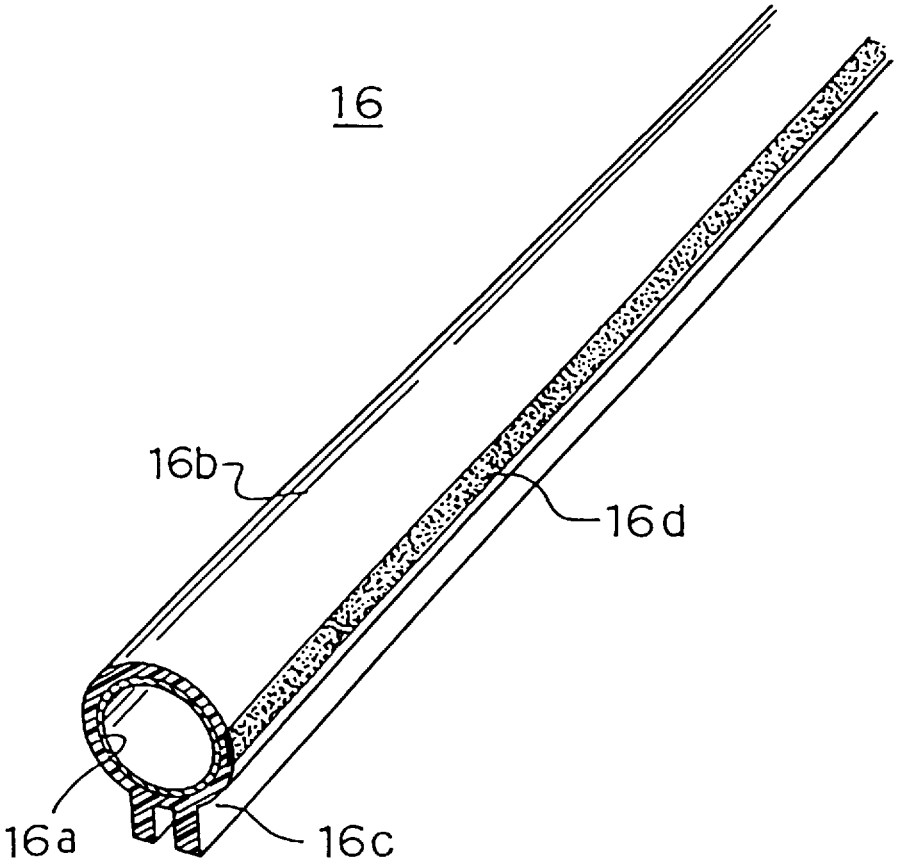
FIG. 3 is a perspective view of a sheathed steel pipe of a second preferred embodiment according to the present invention.

Referring then to FIG. 3, a second preferred embodiment of a sheathed steel pipe 16 with conductive plastic resin is shown. The sheathed steel pipe 16 comprises a tubular body 16*a* being formed of a steel pipe having a thickness of 0.7 millimeter, sheathed in the outside surface with a 1 millimeter-thick film of plastic resin 16*b*, such as ASA, and a strip of conductive resin 16*d*.

A parallel pair of ribs 16*c* are longitudinally formed along the entire length of the sheathed steel pipe 16, and may preferably made integral with the film of plastic resin 16*b*. After sheathing of the film of plastic resin 16*b*, the sheathed pipe 16 measures a range of 28–32 millimeters in diameter.

In an alternative modification, the sheathed steel pipe 16 may be provided with a single longitudinal rib, instead of the paired ribs 16*c*.

A strip of conductive resin 16*d* is formed over the film of plastic resin 16*b* along the longitudinal length of the tubular body 16*a*, and preferably measure 15 millimeters in width and 0.5 millimeter in thickness. The strip of conductive resin 16*d* may preferably be an ABS mixed with carbon black as the conductive additive.

In addition, the strip of conductive resin 16*d* and the film of plastic resin 16*b* may preferably be formed integrally by press extruding. Furthermore, the strip of conductive resin 16*d* may be formed parallelly with the paired ribs 16*c*, spaced from the ribs for a distance of approximately one-fourth of the circumference of the tubular body 16*a* being formed of steel pipe.

The film of plastic resin 16*b* may be tinted in green or ivory to give decorative appearance.

As with the earlier embodiment, the strip of conductive resin 16*d* causes electrostatic charge occurring in the sheathed steel pipe 16 to discharge.

Figure 4:
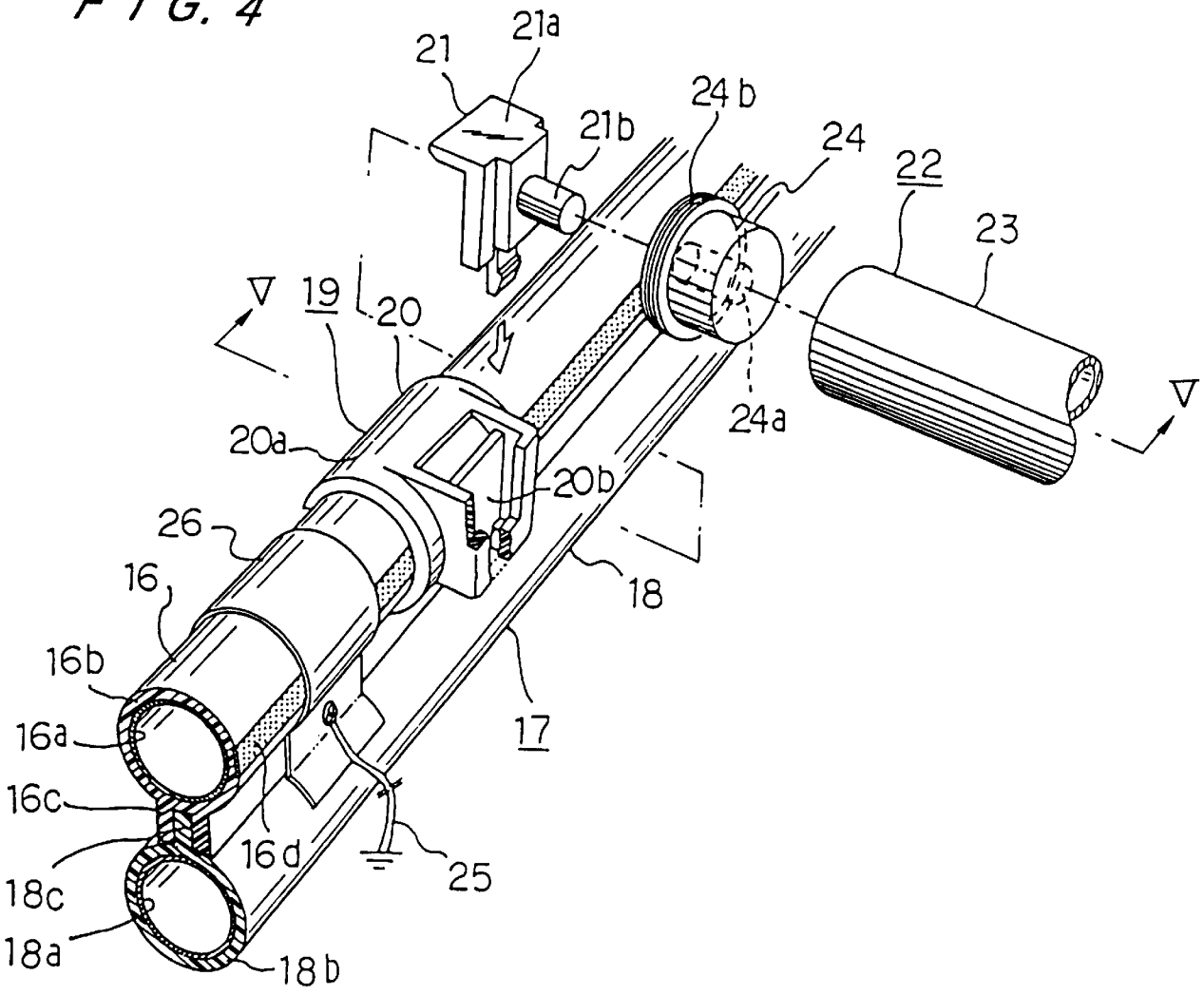
FIG. 4 is a perspective view of a section of a roller conveyor using a sheathed steel pipes of FIG. 3, showing its core components.
Figure 5:
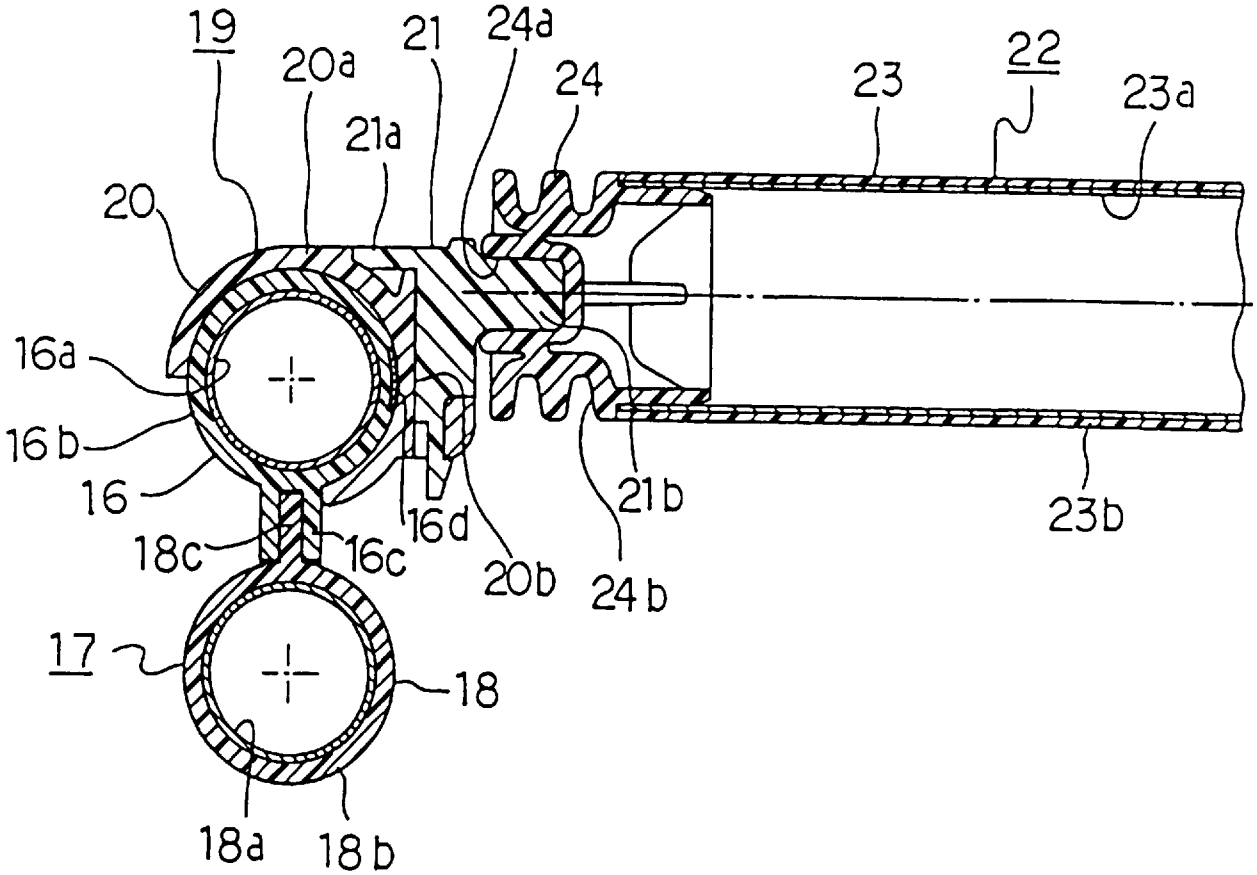
FIG. 5 is a cross-sectional view of the part of the structure of FIG. 4.

Referring next to FIGS. 4 and 5, a fragmental section of one of the roller frames of a roller conveyor, built by sheathed steel pipe 16 of FIG. 3, is shown in perspective and cross-sectional views.

The roller conveyor consists of a pair of upright side frame 17 between which a plurality of endless belt-driven rollers are rotatably disposed in a horizontal plane to carry cargoes on a moving surface, which may comprises the sheathed steel pipe 16 and the sheathed steel pipe 18.

More specifically, the sheathed steel pipe 18 comprises a tubular body 18*a* having a wall thickness of 0.7 millimeter, formed in the outside surface with a film of plastic resin 18*b* such as ASA approximately 1 millimeter in thickness. After sheathing the film of plastic resin film 18*b*, the sheathed steel pipe 18 measures a diameter of 28–32 millimeters in diameter.

The film of plastic resin 18*b* may be tinted in green or ivory. A single stretch of rib 18*c* is formed along the entire length of the tubular body 18*a*, and may be formed integrally by press extruding with the film of plastic resin 18*b*. The rib 18*c* is formed to have a size that allows the tubular body 18*a* to snap into the paired ribs 16*c* of the sheathed steel pipe 16 to form the roller frame 17 of dual pipes, to thereby strengthen the structure of the roller conveyor.

When the sheathed steel pipe 16 and the sheathed steel pipe 18 are complementary connected through their respective ribs 16*c*, 18*c* to form a roller conveyor side frame 17, the strip of conductive resin 16*d* should be made to face inwardly in the conveyor to avoid immediate exposure of the conductive surface for safety's sake.

In the roller conveyor side frame 17, the sheathed steel pipe 16 may preferably be mounted to lay complementary above the sheathed steel pipe 18, with or without supportive legs, not shown, mounted below the frame.

A plurality of roller holders 19 made of a conductive composite resin material, which may be composed of ABS mixed with carbon black as the conductive additive and polycarbonate, are mounted along the sheathed steel pipe 16 of the conveyor side frame 17, at spaced intervals, on both sides of the conveyor.

Each roller holder 19 has a base member 20 composed of a C-shaped clutch 20*a* that snaps onto the sheathed steel pipe 16 and a largely U-shaped pocket 20*b* to removably receive therein the end of a conveyor roller 22 through an end member 21.

The end member 21 comprises a largely inverted L-shaped engaging member 21*a* and a hub member 21*b* that is mounted to extend perpendicular with the longitudinal axis of the roller conveyor body. The pocket 20*b* is engaged with the end member 21 with the perpendicular portion of the L-shaped member 21*a* inserted into the vertical slip of the pocket.

The roller holder 19 holds the conveyor roller 22 rotatably in the pocket 20*b* of the base member 20. The conveyor roller 22 is a tubular member 23 comprising a steel pipe 23*a* having a thickness of 0.7 millimeter, and coated in the outside surface with an approximately 1 millimeter-thick film of conductive plastic resin 23*b*.

The film of conductive plastic resin 23*b* may be PE mixed with carbon black as the conductive additive. After pipe surface extrusion with the film of conductive plastic resin 23*b*, the conveyor roller 22 measures a range of 28–32 millimeters in diameter.

In addition, the conveyor roller 22 has an end cap 24 that is sized to fit into the tubular member 23 at the end of the roller. The end cap 24 is made of the same conductive resin that makes as the film 23*b* for the roller 22. Also, the end cap 24 has an axial hole 24*a* into which the hub 21*b* is inserted to enable the roller holder 19 rotatably holds the roller 22 through the end member 21.

A largely inverted-U shaped grounding terminal 26 is mounted around the sheathed steel pipe 16 to ground the roller conveyor through a lead 25.

The end cap 24 may preferably be provided with a pulley 24*b* that is concentrically mounted around the periphery of the end cap. The pulley 24*b* is driven by a drive pulley, not shown, through an endless belt of a round or V-shaped cross section, not shown, passed about the pulley 24*b*, to turn the conveyor roller 22 about its axis.

Static electricity developed in the conveyor rollers 22 as they turn will be discharged through the grounding terminal 26 and lead 25 via the conductive roller holders 19 and the strip of conductive resin 16*d* of the sheathed steel pipes 16 that make up the roller side frames 17.

With roller conveyors thus built according to the present invention, there will be little danger of injury for factory operators at work or damage to the products carried over the roller due to static electricity.

TABLE 1

| Run No. | Room temperature (°C.) | Room moisture (%) | Electrostatic potential (V) This invention | Electrostatic potential (V) Conventional conveyor |
|---|---|---|---|---|
| 1 | 25 | 76 | 0 | 6000 |
| 2 | 26 | 71 | 100–200 | 5000–6000 |
| 3 | 26 | 76 | 200 | 4500 |
| 4 | 32 | 63 | 0–200 | 7600 |
| 5 | 32 | 63 | 100–200 | 10500 |
| 6 | 27 | 75 | 200 | 6000 |
| 7 | 27 | 60 | 200–300 | 8000 |
| 8 | 30 | 50 | 700 | 8000 |
| 9 | 32 | 57 | 200 | 5000 |

TABLE 1 shows the result of a series of electrostatic potential testing carried out over a number of days under different atmospheric conditions of temperature and moisture, to compare the readings of electrostatic potential occurring in a roller conveyor made of the sheathed sheel pipes according to the present invention and that in a conventional roller conveyor. The mean of measuring electrostatic potential is used a model KSD-0102 digital voltage gauge manufactured by Kasuga Denki KK.

The TABLE 1 shows how less electrostatic potential was in the roller conveyor of the sheathed steel pipes of this invention, compared with the conventional conveyor. In this particular embodiment, the roller side frames 17 uses a double-pipe assembly comprises the sheathed steel pipes 16 and the sheathed steel pipes 18 longitudinally bonded together firmly by means of convex and concave of their ribs 16*c*, 18*c*. However, this design is a matter of choice, and the side frames 17 may comprises a structure of sheathed steel pipe 16 of FIG. 3.

In an alternative modification, the side frames 17 of a roller conveyor may be a dual-pipe structure built of sheathed steel pipes similar to ones 1 depicted in FIG. 1 and complementary ribless sheathed steel pipes laid parallel with the former.

The roller conveyor may not need to have the sheathed steel pipes 16 built into on all sides frames thereof or the entire length of each side frame depending on the type of cargoes to be handled or the entire mechanical structure.

It will be clear from the above that a structure made of the sheathed steel pipes with conductive plastic resin manufactured according to the invention is grounded to discharge static electricity that may occur in the structure. In addition, the sheathed steel pipe costs less since the expensive carbon black, which is used as the conductive additive for grounding the sheathed steel pipe structure, is coated only in a narrow longitudinal strip in the pipe circumference, not the entire pipe external surface as in conventional structure pipes. In addition, the sheathed steel pipe according to the invention leaves a wider freedom of color design for the sheathed steel pipe external surface since the narrow strip of conductive resin of black carbon leaves a wider area to bring the sheathed pipe in a variety of tints of plastic resin for attractive decoration.

What is claimed is:

1. A sheathed tubular body constructed from a plurality of sheathed pipes comprising:

a plurality of sheathed steel pipes;

each of said steel pipes being sheathed with a film of a plastic resin;

at least two of said pipes being parallel to each other, and each of said pipes has at least one longitudinally and radially extending rib at an outer surface of each of said pipes;

said ribs being integral with said film of plastic resin;

said pipes positioned whereby each rib of one pipe is proximal with each rib of another pipe;

a strip of electrically conductive resin being integral with said film of plastic resin of each of said pipes;

said sheathed steel pipes being capable of being connected through said strip to ground to prevent electrostatic charge from accumulating on the sheathed steel pipes during use.

2. The sheathed steel pipe of claim 1, wherein at least one rib of said tubular body is a single row.

* * * * *